US010788050B2

(12) United States Patent
Back et al.

(10) Patent No.: US 10,788,050 B2
(45) Date of Patent: Sep. 29, 2020

(54) ELECTRIC COMPRESSOR AND METHOD FOR PRODUCING AN ELECTRIC COMPRESSOR

(71) Applicant: Magna Powertrain Bad Homburg GmbH, Bad Homburg (DE)

(72) Inventors: Wolfgang Back, Oftering (AT); Michael Hofer, Winklarn (AT); Nicolai Schmolzer, Arriach (AT); Gernot Steinmair, Steyr (AT); Gerd Schlager, Kefermarkt (AT)

(73) Assignee: HANON SYSTEMS EFP DEUTSCHLAND GMBH, Bad Homburg, V.D. Höhe (DE)

( * ) Notice: Subject to any disclaimer, the term of this patent is extended or adjusted under 35 U.S.C. 154(b) by 136 days.

(21) Appl. No.: 15/214,825

(22) Filed: Jul. 20, 2016

(65) Prior Publication Data

US 2017/0037858 A1 Feb. 9, 2017

(30) Foreign Application Priority Data

Aug. 3, 2015 (DE) ..... 10 2015 214 788

(51) Int. Cl.
*F04D 25/08* (2006.01)
*F04D 29/58* (2006.01)
(Continued)

(52) U.S. Cl.
CPC ..... *F04D 29/5806* (2013.01); *F04D 25/06* (2013.01); *F04D 29/023* (2013.01);
(Continued)

(58) Field of Classification Search
CPC .... F04D 25/06; F04D 29/023; F04D 29/4206; F04D 29/5806; F04D 29/5813; F04D 29/284; F02B 33/40; F05D 2220/40
(Continued)

(56) References Cited

U.S. PATENT DOCUMENTS 6,102,672 A 8/2000 Woolenweber et al.
6,903,471 B2 * 6/2005 Arimitsu ..... B60K 6/445 310/59
(Continued)

FOREIGN PATENT DOCUMENTS

CN 101073190 A 11/2007
CN 104638838 A 5/2015
(Continued)

OTHER PUBLICATIONS

Groover, Mikell P., Fundamentals of Modern Manufacturing: Materials, Processes, and Systems, 2007, John Wiley and Sons, 3rd Edition, pp. 223-224 (Attached PDF).*
(Continued)

*Primary Examiner* — Connor J Tremarche
(74) *Attorney, Agent, or Firm* — Dickinson Wright PLLC

(57) ABSTRACT

An electric compressor for compressing a gas, particularly configured for use in a motor vehicle, comprising a control unit, an electric motor controlled by the control unit, a compressor wheel driven by the electric motor, and a housing at least partially surrounding the electric motor. The housing is produced by an encapsulation method such that a cooling structure is formed integrally with the housing, in particular within the housing, for ensuring cooling of the electric motor and of the control unit. A method for producing the electric compressor of this kind is also disclosed.

15 Claims, 10 Drawing Sheets

(51) Int. Cl.

| | |
|---|---|
| ***F04D 29/02*** | (2006.01) |
| ***F04D 29/42*** | (2006.01) |
| ***F04D 29/28*** | (2006.01) |
| ***F04D 25/06*** | (2006.01) |
| ***F02B 33/40*** | (2006.01) |

(52) U.S. Cl.
CPC ..... *F04D 29/4206* (2013.01); *F04D 29/5813* (2013.01); *F04D 29/284* (2013.01); *F05D 2220/40* (2013.01)

(58) Field of Classification Search
USPC ..... 417/423.14
See application file for complete search history.

(56) References Cited

U.S. PATENT DOCUMENTS

| | | | | |
|---|---|---|---|---|
| 7,164,218 | B2 * | 1/2007 | Kimura | F04C 23/008 310/216.044 |
| 2002/0167232 | A1 * | 11/2002 | Randall | H02K 9/22 310/54 |
| 2003/0059299 | A1 | 3/2003 | Miura et al. | |
| 2005/0073212 | A1 * | 4/2005 | Semones | H02K 21/24 310/216.008 |
| 2008/0278011 | A1 * | 11/2008 | Elgas | H02K 5/20 310/52 |
| 2009/0104055 | A1 * | 4/2009 | Satou | F04B 35/04 417/410.1 |
| 2012/0068557 | A1 * | 3/2012 | Duesing | H02K 5/08 310/43 |
| 2012/0128512 | A1 * | 5/2012 | Vande Sande | F04D 25/0606 417/410.1 |

FOREIGN PATENT DOCUMENTS

| | | | |
|---|---|---|---|
| DE | 102006029803 | A1 | 1/2008 |
| DE | 102008022516 | A1 | 11/2008 |
| DE | 102008003784 | A1 | 7/2009 |
| JP | 2001041191 | A | 2/2001 |
| WO | WO9910654 | A1 | 3/1999 |

OTHER PUBLICATIONS

Search Report dated Jul. 19, 2016 in corresponding German Patent Application No. 102015214788.6.

Search Report dated Apr. 28, 2018 issued by the Chinese State Intellectual Property Office in corresponding Chinese Patent Application No. 201610621456.9.

* cited by examiner

ELECTRIC COMPRESSOR AND METHOD FOR PRODUCING AN ELECTRIC COMPRESSOR

CROSS-REFERENCE TO RELATED APPLICATIONS

This application claims the benefit and priority of German Application No. DE 102015214788.6, filed on Aug. 3, 2015. The entire disclosure of the above application is incorporated herein by reference.

TECHNICAL FIELD

The present invention relates generally to an electric compressor for compressing a gas, and in particular to such an electric compressor for a motor vehicle, and to a method for producing an electric compressor.

BACKGROUND

This section provides background information related to the present disclosure which is not necessarily prior art.

In general, compressors in the automotive sector are associated especially with the desire for an increase in the power and efficiency of an internal combustion engine of a motor vehicle.

One of the probably best known embodiments of a compressor is the exhaust turbocharger. The exhaust turbocharger is used to ensure an adequate quantity of combustion air in the cylinders of the internal combustion engine by compressing ambient air or an ambient air/exhaust gas mixture and thus supplying the cylinders with this combustion air at excess pressure.

In general, exhaust turbochargers consist of an exhaust turbine and a compressor wheel, wherein the exhaust turbine and the compressor wheel are arranged on a common shaft. The exhaust turbine converts the heat and kinetic energy of the exhaust gas from the internal combustion engine into rotational energy. This rotational energy is transferred via the common shaft to the compressor wheel. By means of the compressor wheel, ambient air or a mixture of ambient air and exhaust gas is drawn in and compressed. It is thereby possible to achieve a higher working pressure for the same temperature in the cylinder of the internal combustion engine.

As long as there is sufficient exhaust gas flowing in on the side of the internal combustion engine and driving the exhaust turbine, the speed of rotation is sufficient to bring about an excess pressure on the intake side. However, when accelerating the motor vehicle, for example, the turbo may respond with a delay (even) at relatively high speeds of rotation—this state being commonly known as "turbo lag".

There are many approaches to counteracting the occurrence of turbo lag. For example, the inertia of the exhaust turbine can be reduced by making it smaller. Although this lowers the efficiency of the turbo, the exhaust turbine can be driven even by a weak exhaust gas flow.

Another approach in this context is the use of an (additional) electrically driven compressor (electric compressor), for example, which is configured to operate independently of the exhaust gas flow of the internal combustion engine. An electrically driven compressor generally likewise has a compressor wheel, although this can be driven by an electric motor.

The publication WO 99/10654 describes an electrically driven compressor, for example, wherein the compressor and the electric drive motor are arranged coaxially with one another on a shaft and are accommodated in a common housing. In particular, the primary object here is to specify a compressor which is of as small construction as possible.

In planning an electric compressor, an embodiment of the overall compressor which is, in particular, optimized in terms of components and compact is the primary consideration.

In the case of high-speed engine components such as an electric compressor, there are high induced electrical voltages owing to the high speeds of rotation. During operation, these high voltages and the applied currents lead to heat generation, which must be dissipated by external cooling to be able to ensure continuous operation at predetermined power levels.

The publication DE 10 2008 003 784 A1, for example, describes a device and a method for the full encapsulation of stators of electric motors having internal rotors. In the method described, rotation is imparted to the stator during and/or after the introduction of a fluid casting compound, wherein the casting compound is introduced radially from the inside outwards, with the result that the casting compound is distributed so as to fill cavities and in a uniform manner during the rotation process. Owing to the centrifugal forces which the rotation exerts on the casting compound, the casting compound is forced into all the cavities and windings of the stator. In this process, the stator is fully encapsulated. By means of full encapsulation of the stator and, in particular, of the stator windings, the electric motor can be made very compact and, depending on the full encapsulation material used, heat transfer from the stator or stator winding to the housing can be influenced in a positive way—the housing representing the heat sink here.

SUMMARY

This section provides a general summary of the disclosure, and is not a comprehensive disclosure of its full scope or all of its features.

On the one hand, it is an object of the invention to specify an electric compressor which, while being of compact construction, can be operated at high power and, on the other hand, it is an object of the invention to specify a simple method for producing a compressor of this kind.

The solution of the first aspect of the object is accomplished by an electric compressor for compressing a gas, in particular for a motor vehicle, comprising a control unit, an electric motor, wherein the electric motor can be controlled by means of the control unit, a compressor wheel, wherein the compressor wheel can be driven by means of the electric motor, and a housing, wherein the housing at least partially surrounds the electric motor, wherein the housing is produced in such a way by means of an encapsulation method that a cooling structure is formed integrally with the housing, in particular in the housing, ensuring cooling of the electric motor and of the control unit.

The solution of the second aspect of the object is accomplished by a method for producing an electric compressor of this kind, wherein the housing is produced in such a way by means of an encapsulation method that a cooling structure is formed integrally with the housing, in particular in the housing.

The electric compressor according to the invention has a control unit, an electric motor, a compressor wheel and a housing.

According to the invention, the electric motor can be controlled by means of the control unit and is used for selective driving of the compressor wheel.

The control unit represents the power and signal electronics for the electric motor and preferably comprises a circuit board, on which various electronic modules, e.g. capacitors, semiconductor chips etc. can be arranged.

However, the control unit can also be taken to mean a plug connector, in which case the circuit board, including the various electronic modules arranged thereon, is embodied as an external control module.

The compressor wheel and the electric motor are preferably arranged coaxially on a common shaft, wherein the shaft is formed along a central axis of rotation of the electric motor.

The electric motor has a rotor and a stator having at least one stator winding but, in general, a plurality of stator windings.

The control unit is arranged along the central axis of rotation of the electric motor, preferably coaxially with the electric motor, and is connected electrically to the electric motor, more precisely to the stator windings of the stator of the electric motor, by at least one connecting element.

According to the present invention, the electric motor is used to drive the compressor wheel.

The rotor of the electric motor is preferably arranged for conjoint rotation on the shaft and/or is formed integrally with the shaft.

The compressor wheel is preferably arranged for conjoint rotation on the shaft and/or is formed integrally with the shaft.

The rotational energy generated by the electric motor is transferred to the compressor wheel via the common shaft.

According to the invention, the housing of the electric compressor according to the invention is used to at least partially accommodate the electric motor, in particular the stator of the electric motor.

The housing of the electric compressor according to the invention is preferably used to at least partially accommodate the control unit.

According to the invention, the housing is produced by means of an encapsulation method, wherein a cooling structure is formed integrally with the housing, in particular in the housing.

The encapsulation method is preferably an injection moulding method or a diecasting method.

Here, polymeric materials, e.g. thermosetting plastics, thermoplastics etc. are used as casting compounds, for example. In general, these materials are filled with inorganic materials in order to improve certain material properties, e.g. thermal conductivity.

By means of the embodiment according to the invention of the electric compressor, efficient cooling, particularly of the electric motor and of the control unit, can be achieved. In this way, given appropriate choice of the casting compound used in the encapsulation method, a higher power of the electric motor combined with compact and simple construction can be achieved in a simple manner. Moreover, reliable operation of the electric compressor in a manner which is optimized in terms of service life can be ensured, particularly through the efficient cooling of the control unit.

The housing at least partially performs the protection of the electric motor from external negative influences, e.g. contaminants, and furthermore performs the cooling function of the electric motor.

The method according to the invention for producing an electric compressor described above comprises producing the housing by means of an encapsulation method, wherein the encapsulation method is performed in such a way that the cooling structure is formed integrally with the housing, in particular in the housing.

Through the production, according to the invention, of a housing with an integrated cooling structure for efficient cooling of the electric motor and of the control unit of the electric compressor according to the invention, it is possible to dispense with additional components in this region.

Moreover, the production according to the invention of the electric compressor also makes it possible to optimize and/or eliminate other components, e.g. in the region of the mounting of the shaft.

At the same time, the production method can be carried out in a simple manner, and the cooling structure in the housing can be configured on an individual basis, depending on the cooling requirements and design configuration of the electric motor and of the control unit.

In an advantageous embodiment of the present invention, the cooling structure has a plurality of cooling ducts.

In this way, appropriate cooling of the electric motor and of the control unit can be accomplished in a simple manner.

In another advantageous embodiment of the electric compressor according to the invention, the cooling structure is formed at least partially around the outer circumference of the stator of the electric motor.

The stator has at least one stator winding, preferably a plurality of stator windings.

Forming the cooling structure at least partially around the outer circumference of the stator allows efficient cooling, especially of the electrically loaded stator winding.

The stator is preferably of substantially annular design and has a plurality of axially extending recesses uniformly spaced apart along its outer circumference.

The direction indication "axially" refers to a direction along the central axis of rotation of the electric motor.

It is advantageous if the cooling structure has a number of cooling ducts corresponding to the number of recesses of the stator.

However, it is also possible for there to be more or fewer cooling ducts around the stator.

It is furthermore advantageous if the cooling ducts extend axially along the recesses of the stator.

Through the configuration of the recesses of the stator and furthermore of the arrangement of one cooling duct of the cooling structure in each recess, an extremely compact construction combined with efficient cooling, particularly of the stator, is achieved.

In another advantageous variant embodiment of the present invention, the cooling structure is formed at least partially on a rear side of the control unit.

In this way it is possible to ensure cooling of further high-load electronic components in a simple manner.

The housing is preferably manufactured from an electrically insulating material of good thermal conductivity.

The cooling structure is preferably produced by means of internal-pressure injection moulding and/or by the introduction of at least one moulding body.

Moreover, in an advantageous embodiment of the invention, at least one opening is formed by means of internal-pressure injection moulding and/or by the introduction of at least one opening moulding body.

Through the formation, for example, of a central opening along the central axis of rotation of the electric motor, within the stator of the electric motor, installation space for the shaft and the rotor can be configured in a simple manner.

By way of example, the moulding body and the opening moulding body are arranged, together with that part of the electric compressor according to the invention which is to be encapsulated, at least in part the electric motor of the electric compressor according to the invention, in a suitable encapsulation device and encapsulated with casting compound.

After the encapsulation process, i.e. after the curing of the casting compound, the moulding body and the opening moulding body are preferably removed mechanically and/or vaporized by a chemical reaction and/or a thermal reaction.

In the case of the formation of the cooling structure and/or of the opening by means of internal-pressure injection moulding, a filler, e.g. water or an inert gas such as nitrogen, is introduced into a gas-tight device partially filled with fluid uncured casting compound. In the device, the filler acts as an internal moulding piece and displaces the casting compound radially from the inside outwards in the direction of the inner walls of the device. In this way, a cavity is created within the casting compound. After the casting compound has cured, the filler can escape from the device, and the cavity created forms the cooling structure.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

The invention is described below by way of example with reference to the drawings.

DESCRIPTION

One or more example embodiments of an electric compressor are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
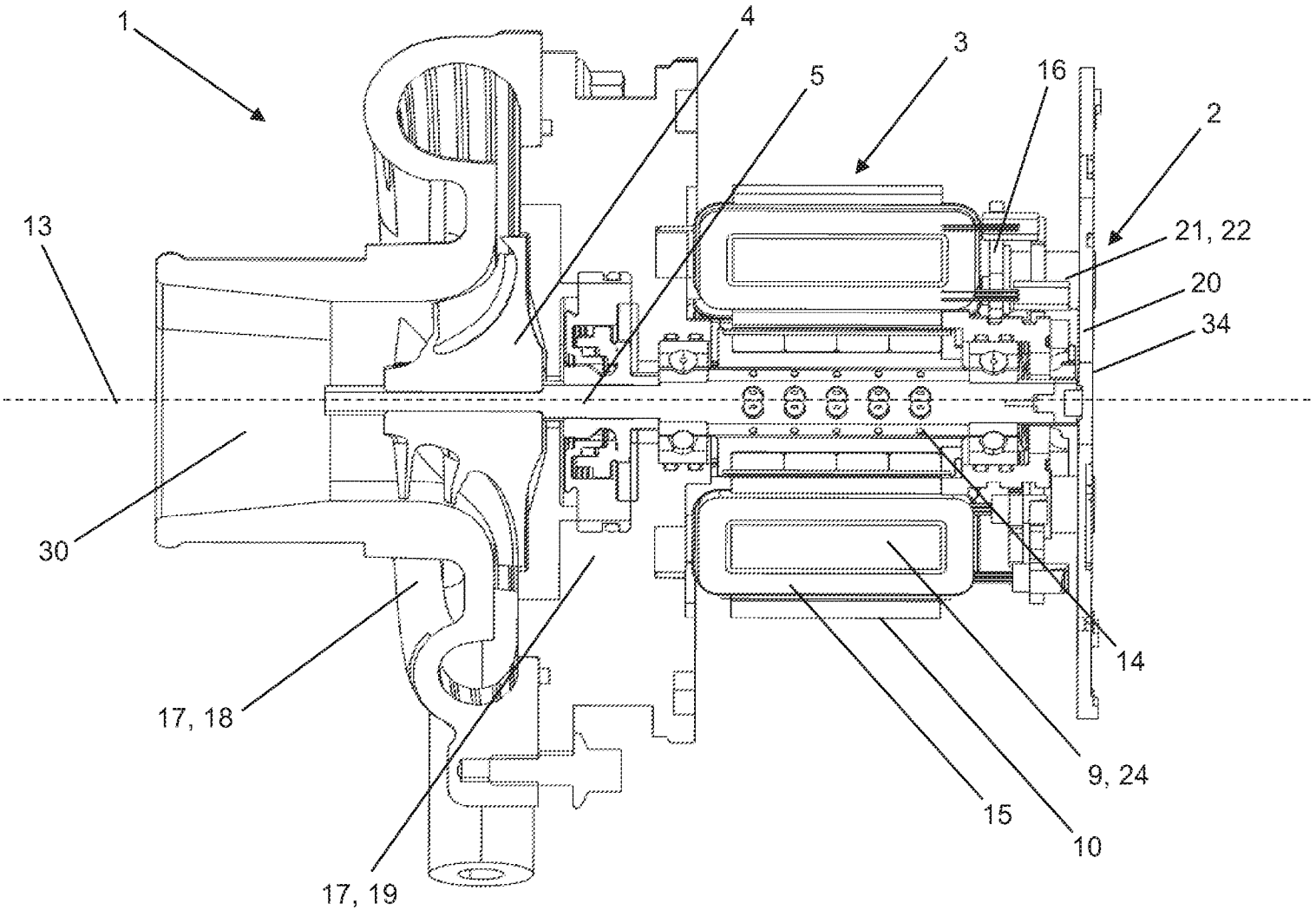
FIG. 1 shows a longitudinal section through an electric compressor according to the invention.
Figure 4:
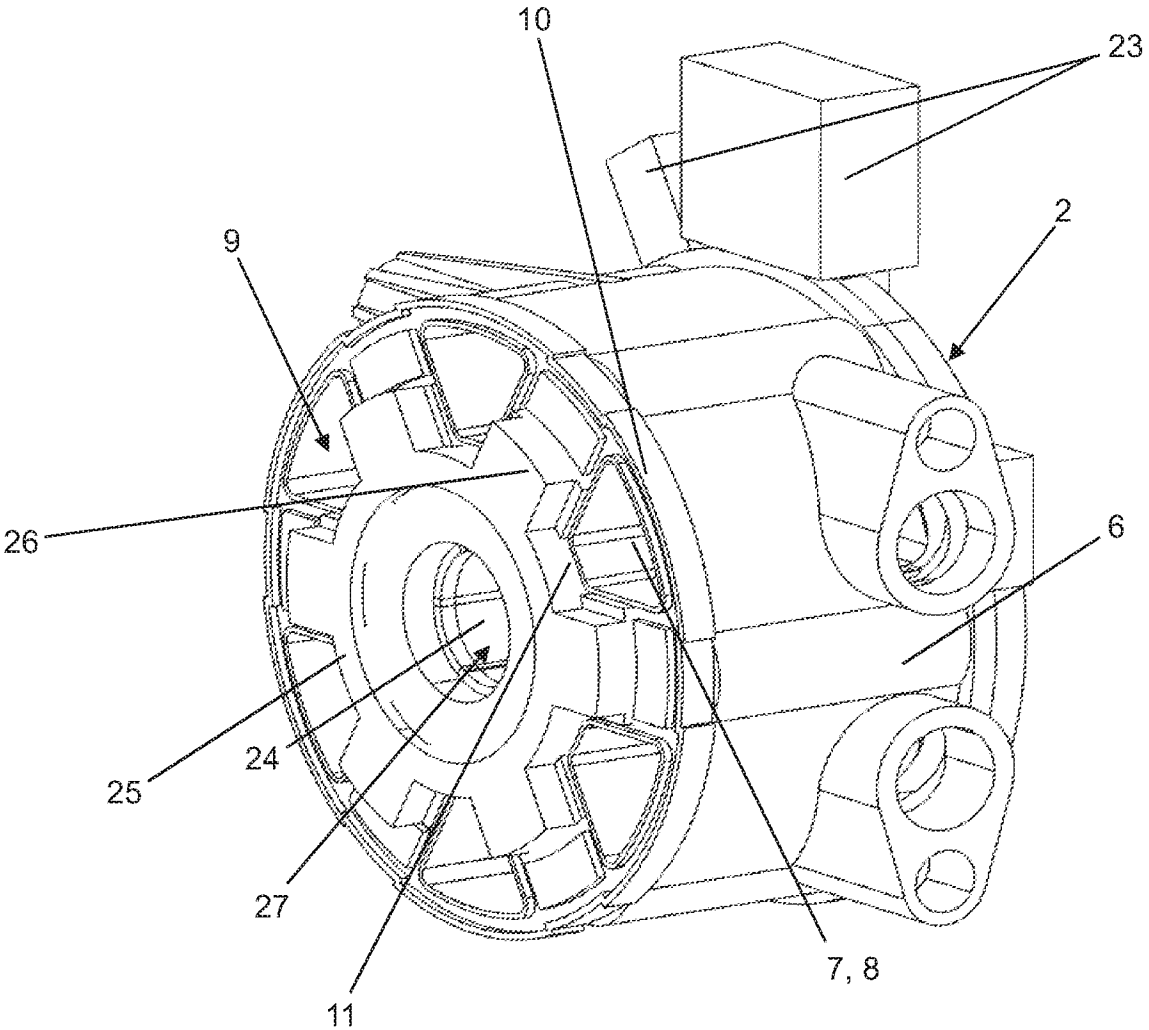
FIG. 4 shows a perspective view of a housing, including a control unit, and of a stator of an electric motor of an electric compressor according to the invention.

An electric compressor, shown in FIG. 1, is configured to include a control unit 2, an electric motor 3, a compressor wheel 4 and a housing 6 (FIG. 4). The electric motor 3 can be controlled by means of the control unit 2 and is used for selective driving of the compressor wheel 4. The compressor wheel 4 and the electric motor 3 are arranged coaxially on a common shaft 5, wherein the shaft 5 is formed along a central axis of rotation 13 of the electric motor 3. The compressor wheel 4 is arranged in a compressor wheel housing 17. The compressor wheel housing 17 is formed by the joining together of a first compressor wheel housing part 18 and a second compressor wheel housing part 19.

The electric motor 3 is designed as an internal-rotor electric motor and has a rotor 14 with permanent magnets and a stator 9 with six stator windings 15. The electric motor 3 is used to drive the compressor wheel 4. The rotor 14 of the electric motor 3 is arranged for conjoint rotation on the shaft 5. The compressor wheel 4 is arranged for conjoint rotation on the shaft 5. The rotational energy generated by the electric motor 3 is transferred to the compressor wheel 4 via the common shaft 5.

The control unit 2 is arranged coaxially with the electric motor 3 along the central axis of rotation 13 of the electric motor 3 and is connected electrically to the electric motor 3, more precisely to the stator windings 15 of the stator 9 of the electric motor 3, by at least one connecting element 16.

Figure 2:
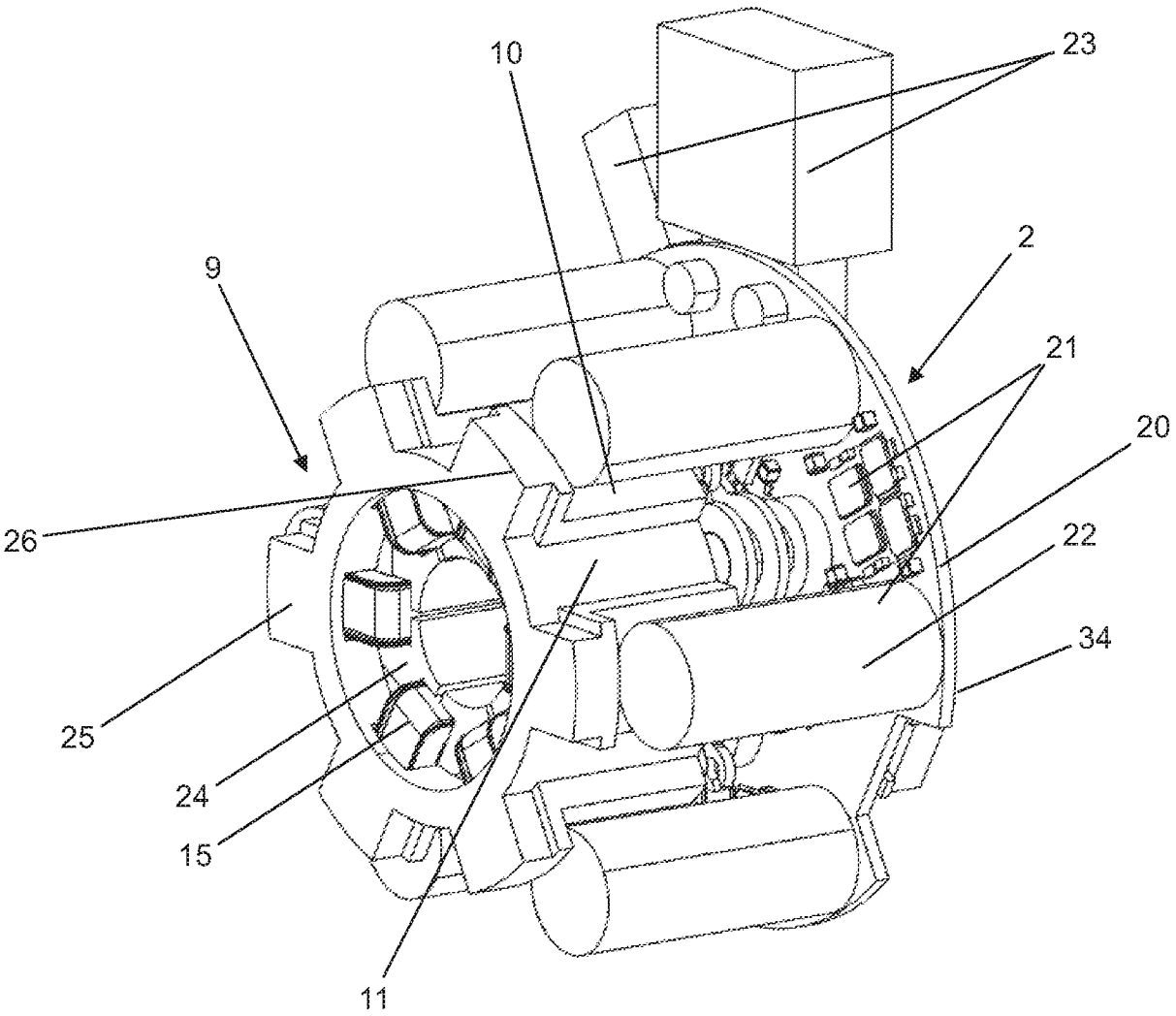
FIG. 2 shows one perspective view of a control unit and of a stator of an electric motor of an electric compressor according to the invention.

FIG. 2 shows a perspective view of a control unit 2 and of a stator 9 of an electric motor 3 of an electric compressor 1 according to the invention. The control unit 2 represents the power and signal electronics for the electric motor 3 and comprises a circuit board 20, on which various electronic modules 21 are arranged, in this case including capacitors 22, and in this case likewise two plug connectors 23. The two plug connectors 23 are, on the one hand, a power connector and, on the other hand, a signal connector.

The stator 9 of the electric motor 3 comprises six individual stator segments 24, six stator windings 15, which are arranged on the stator segments 24, and a stator carrier 25. The stator carrier 25 is of annular design and surrounds the stator segments 24 and the stator windings 15. The outer circumference of the stator carrier thus forms the outer circumference 10 of the stator 9 of the electric motor 3. On the outer circumference 10, the stator carrier 25 has a plurality of uniformly spaced, axially extending recesses 11. The direction indication "axially" refers to a direction along the central axis of rotation 13 of the electric motor 3. In the region between each of the recesses 11, the stator carrier 25 has projections 26 in the region of a side facing away from the control unit 2.

The projections 26 extend radially over a part of the outer circumference 10 of the stator carrier 25 in the region between two recesses 11. The direction indication "radially" refers to a direction normal to the central axis of rotation 13 of the electric motor 3. The projections 26 are embodied in such a way that the capacitors 22 of the control unit 2 can extend axially along the stator 9 as far as the projections 26 in the region between two recesses 11. In this way, a compact and robust arrangement of the electric motor 3 and of the control unit 2 is achieved.

Figure 3:
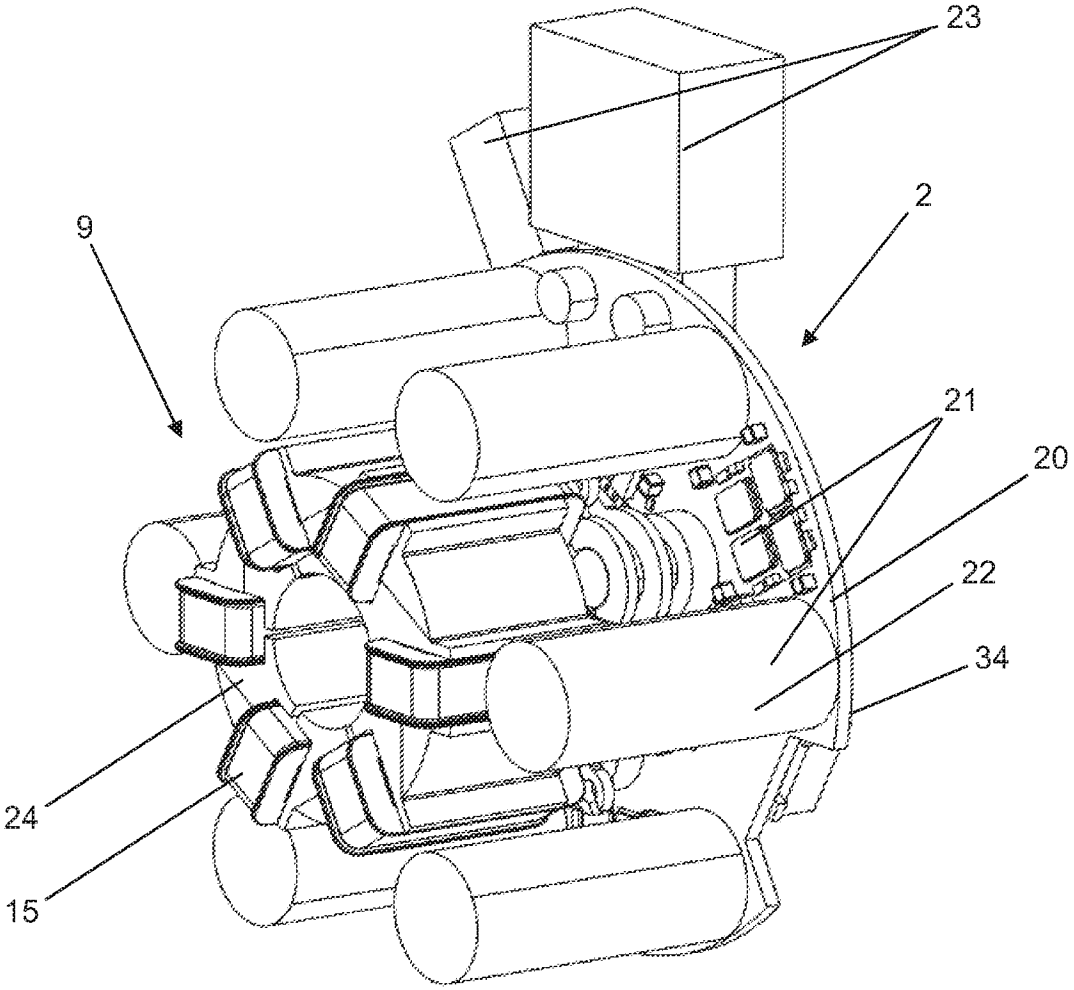
FIG. 3 shows a perspective detail view from FIG. 3.

The perspective view, already described by means of FIG. 2, of the control unit 2 and of the stator 9 of an electric motor 3 without the stator carrier is shown in FIG. 3. Here, the six stator windings 15 of the stator can be seen. The rotor 14

(not shown; FIG. 1) arranged on the shaft 5 is arranged in the region of the central opening 27 of the stator 9.

Figure 5:
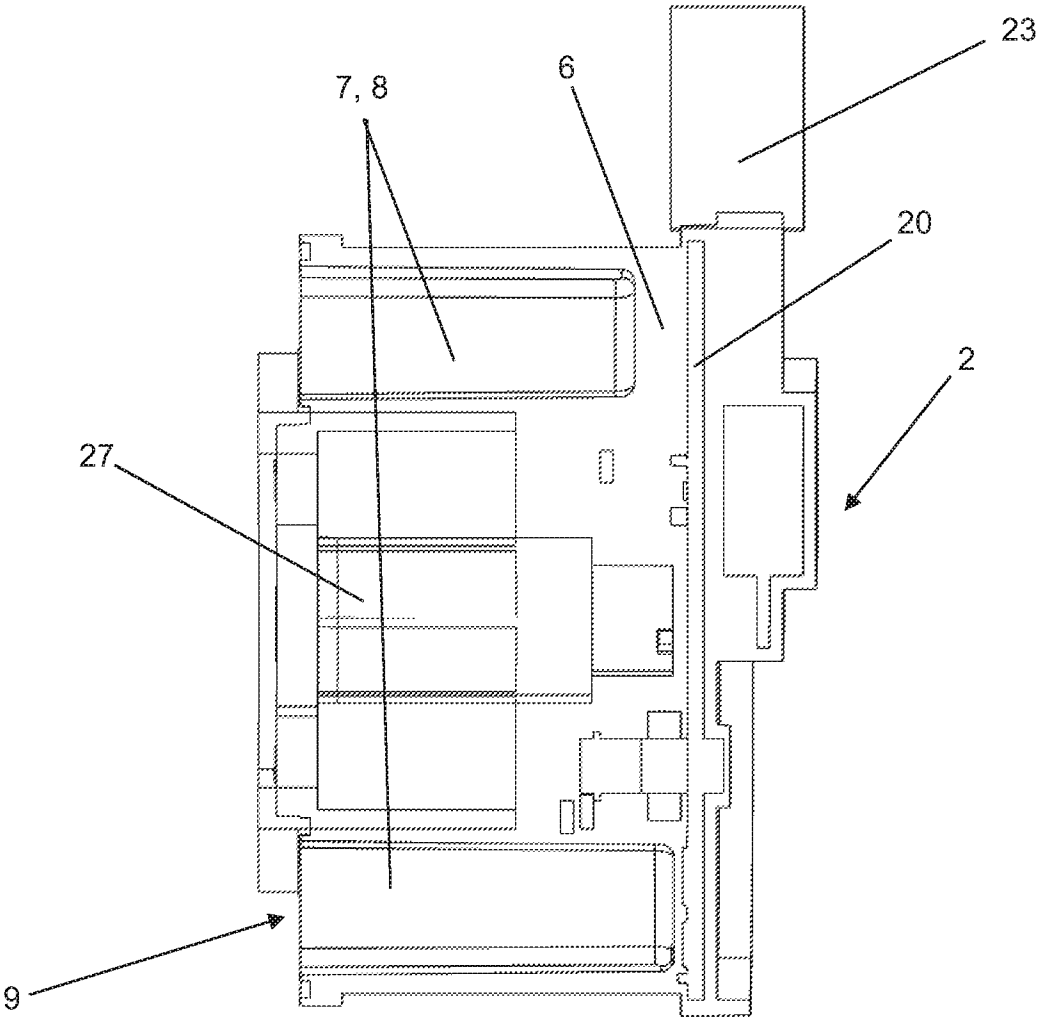
FIG. 5 shows FIG. 4 in a longitudinal section.

FIG. 4 shows the perspective view, already described by means of FIG. 2 and FIG. 3, of the control unit 2 and of the stator 9 of an electric motor 3 with the housing of the electric compressor 1 according to the invention. FIG. 5 shows a longitudinal section through the perspective illustration in FIG. 4. The stator 9 of the electric motor 3 and the control unit 2 are arranged in the housing 6 of the electric compressor 1 according to the invention. The housing 6 is produced by an encapsulation method, wherein a cooling structure is formed in the housing 6, integrally with the housing 6.

The cooling structure 7 has a plurality of cooling ducts 8, wherein the cooling ducts 8 are formed around the outer circumference 10 of the stator of the electric motor 3, the cooling ducts 8 extending, in particular, axially along the recesses 11 of the stator (of the stator carrier 25). The cooling structure 7 of the illustrative electric compressor 1 under consideration has a number of cooling ducts 8 corresponding to the number of recesses 11 of the stator 9, i.e. six cooling ducts 8.

The cooling ducts 8 each extend radially from the recess 11 on the outer circumference 10 of the stator 9 into the region of the capacitors 22 of the control unit 2, which extend axially along the outer circumference 10 of the stator 9, in each case between two recesses 11. Here, the radial extent of the projections 26 is shorter than the radial extent of the cooling ducts 8. The cooling ducts 8 serve not only to cool the electric motor 3 but are also used to cool the capacitors 22. Via the cooling duct passages 28, the rear side 34 of the control unit 2, namely that side of the control unit 2 which faces away from the electric motor 3, is also cooled.

Figure 6:
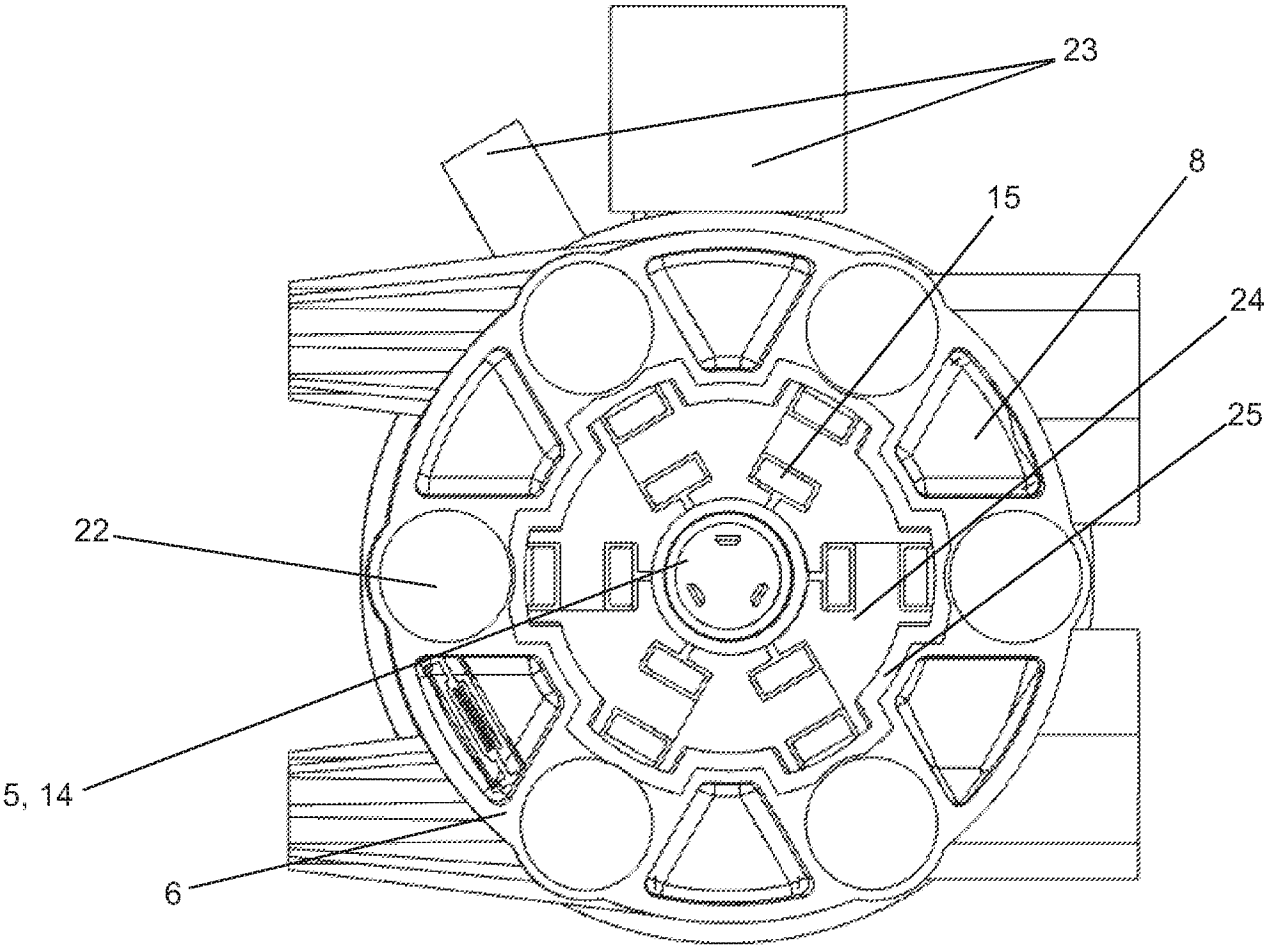
FIG. 6 shows FIG. 4 in a cross section.

A first cross section through the perspective view, shown in FIG. 4, of the control unit 2 and of the stator 9 of an electric motor 3, together with the housing 6 of the electric compressor 1 according to the invention, is shown in FIG. 6. Here, it is possible to see, in particular, the distribution of the projections 26, of the capacitors 22 and of the cooling ducts 8 along the outer circumference 10 of the stator carrier 25.

Figure 7:
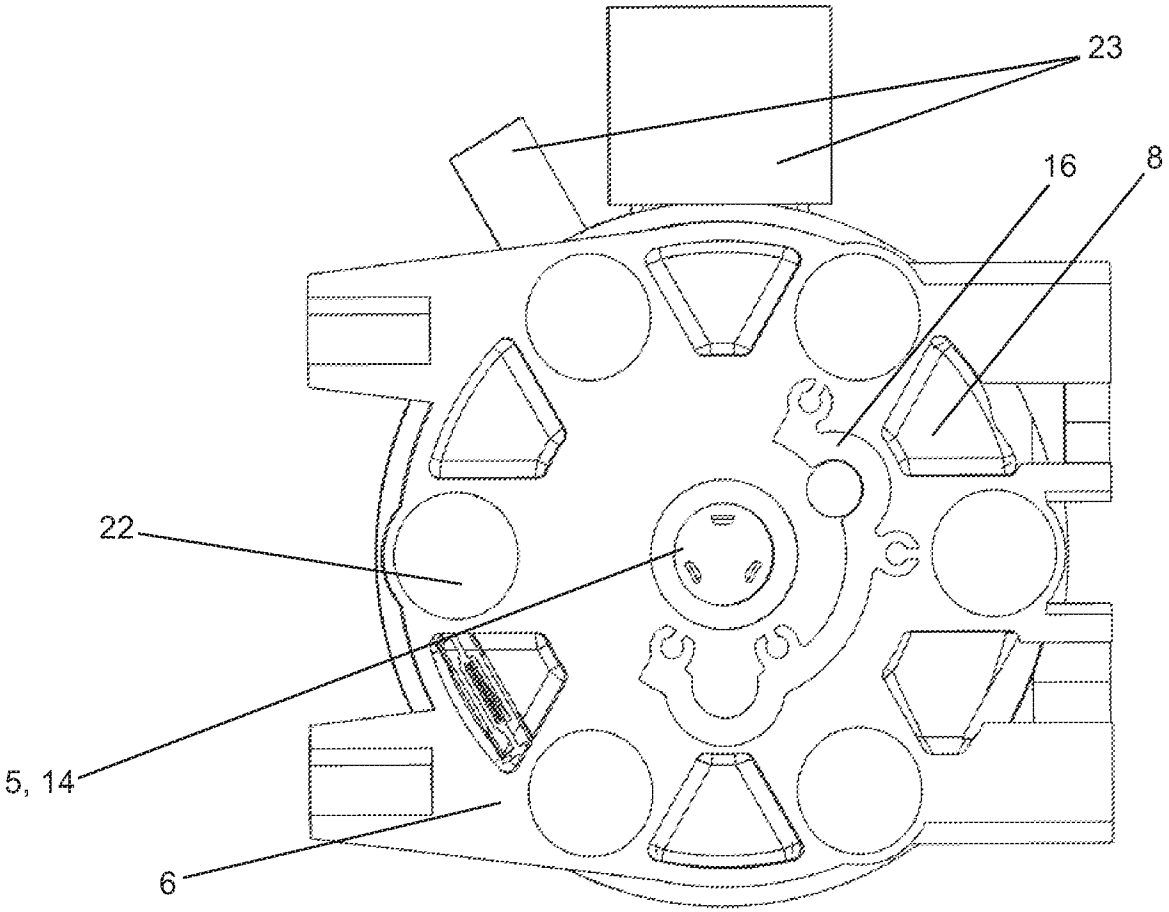
FIG. 7 shows FIG. 4 in another cross section at the interface between the electric motor and the control unit.

FIG. 7 shows another cross section through the perspective view, shown in FIG. 4, of the control unit, together with the housing 6 of the electric compressor 1 according to the invention, at the interface between the electric motor 3 and the control unit 2. Here too, the distribution of the capacitors 22 and of the cooling ducts 8 along the outer circumference 10 of the stator carrier 25 can be seen. Moreover, one of three connecting elements 16, by means of which the electric motor 3 is connected electrically to the control unit 2, is shown. The connecting elements 16 represent the electrical interface between the electric motor 3, more precisely the stator windings 15, and the control unit 2.

Figure 8:
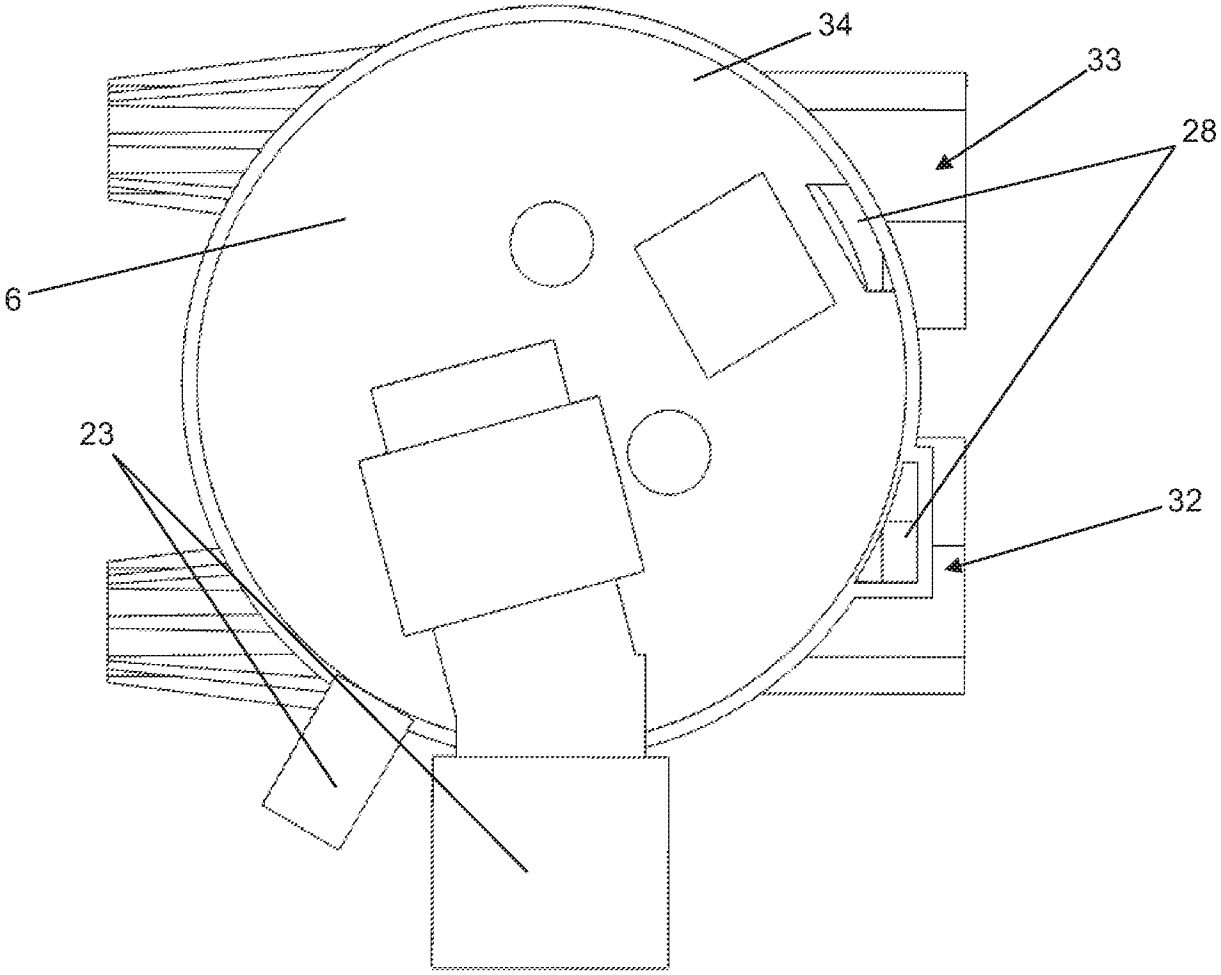
FIG. 8 shows a plan view of the control unit according to FIG. 4.

A plan view of control unit 2, as it is shown in FIG. 4, is shown in FIG. 8. In the region of the control unit 2, the cooling structure 7 of the electric compressor 1 according to the invention has two cooling-duct passages 28, which serve to cool the rear side 34 of the control unit 2, namely that side of the control unit 2 which faces away from the electric motor 3, wherein in this way the cooling of further high-load electronic modules 21 of the control unit 2 is accomplished, in particular. The cooling structure 7 is supplied with cooling fluid via a cooling-fluid inlet 32 and a cooling-fluid outlet 33.

The method according to the invention for producing the electric compressor 1 described comprises the production of the housing 6 by means of an encapsulation method, wherein the encapsulation method is performed in such a way that the cooling structure 7, that is to say in this case the cooling ducts 8, is (are) formed integrally with the housing 6, in the housing 6. Here, the cooling structure 7 is produced by introducing moulding bodies 12.

Figure 9:
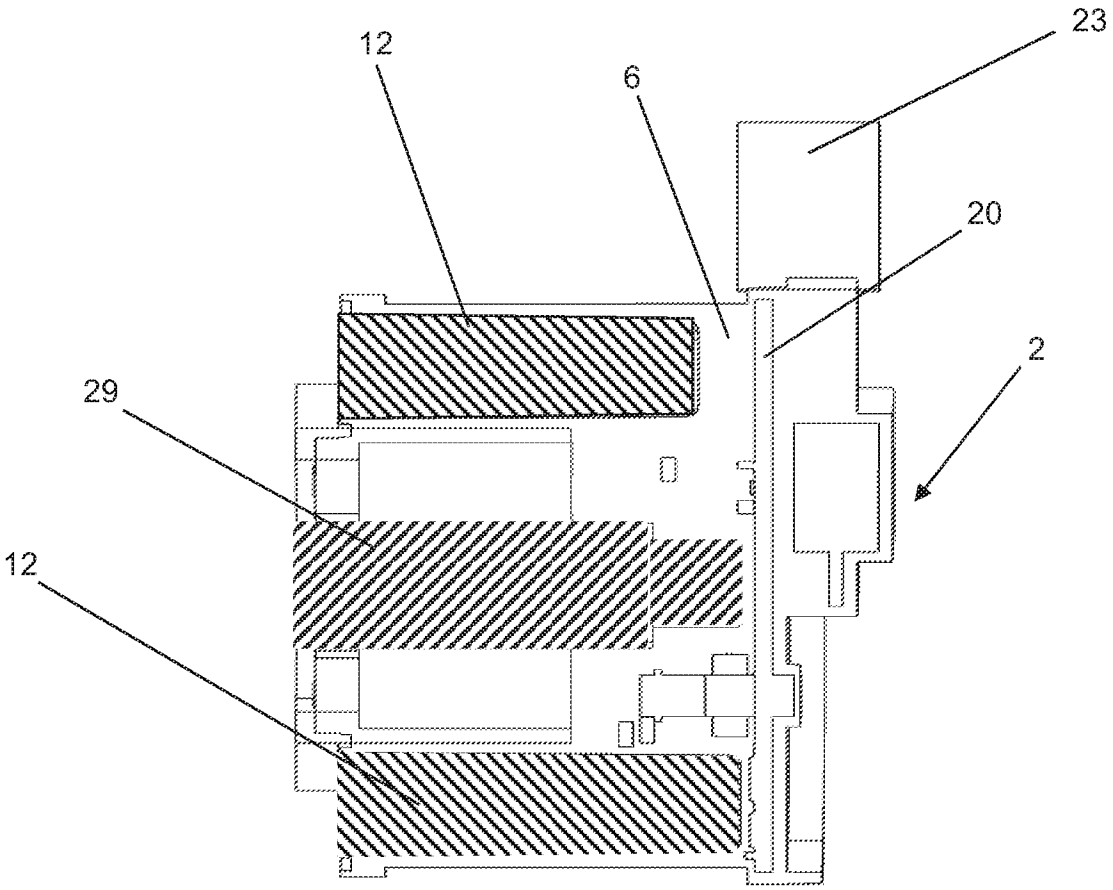
FIG. 9 shows FIG. 4 in another longitudinal section, including arranged mould parts.

FIG. 9 shows a longitudinal section through the perspective view, shown in FIG. 4, with inserted moulding bodies 12 and an opening moulding body 29. After the encapsulation process, the moulding bodies 12 and the opening moulding body 29 are removed mechanically.

The moulding bodies 12 and the opening moulding body 29 may also be removed by a chemical reaction and/or by a thermal reaction after the encapsulation process along with, or without the mechanical removal process.

As shown in FIG. 9, the moulding bodies 12 serve to form the cooling ducts 8 of the cooling structure 7 and, in accordance with the illustrative embodiment under consideration, have a trapeziform cross section, resulting in the formation of trapeziform cooling ducts 8 in the housing. However, the moulding bodies 12 and thus the cooling ducts 8 can be configured in any desired shape. The opening moulding body 29 serves to form the central opening 27 and has a substantially circular cross section, resulting in a circular central opening 27 for the arrangement of the shaft 5 and of the rotor 14.

In this illustrative embodiment, the stator 9 and the control unit 2 are completely encapsulated by means of the encapsulation method, with only those points at which the moulding bodies 12 and the opening moulding body are inserted remaining free, thus forming the cooling structure 7 and also the central opening 27.

Figure 10:
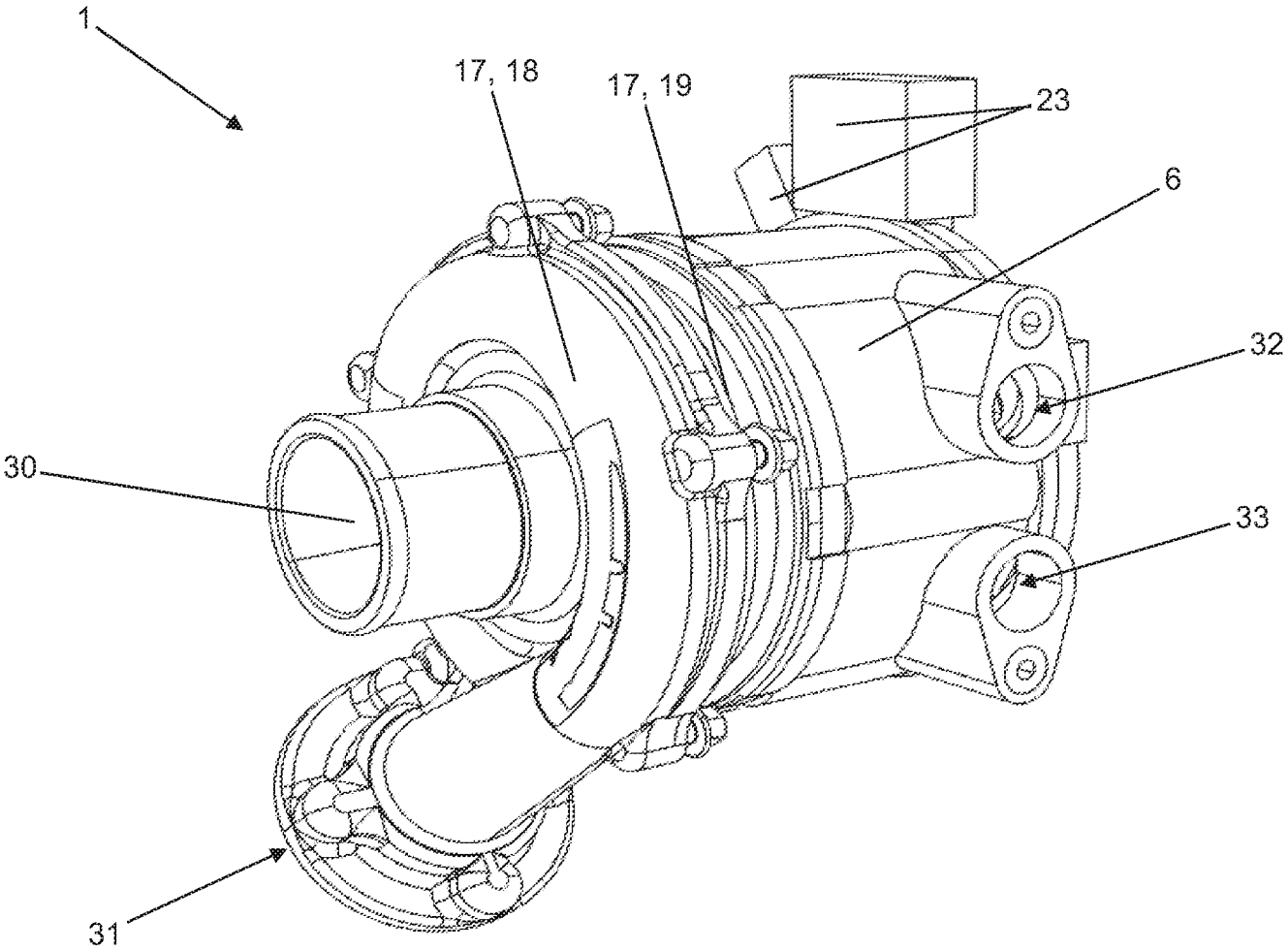
FIG. 10 shows a perspective illustration of the electric compressor according to the invention.

FIG. 10 shows the illustrative electric compressor 1 according to the invention, shown in FIG. 1 in a longitudinal section, in a perspective view, wherein in this case a compressor gas inlet 30 and a compressor gas outlet 31 are formed on the compressor wheel housing 17. The assembly of the compressor wheel housing 17 and of the housing 6 of the electric compressor 1 is furthermore visible.

According to the present invention, the compressor wheel housing 17 can also be formed integrally with the housing 6 of the electric compressor 1.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

LIST OF REFERENCE SIGNS

1. electric compressor
2. control unit
3. electric motor
4. compressor wheel
5. shaft
6. housing
7. cooling structure
8. cooling duct
9. stator
10. outer circumference (of the stator/stator carrier)
11. recess
12. moulding body
13. central axis of rotation
14. rotor

15. stator winding
16. connecting element
17. compressor wheel housing
18. first compressor wheel housing part
19. second compressor wheel housing part
20. circuit board
21. electronic modules
22. capacitors
23. plug connector
24. stator segment
25. stator carrier
26. projection
27. opening
28. cooling duct passage
29. opening moulding body
30. compressor gas inlet
31. compressor gas outlet
32. cooling fluid inlet
33. cooling fluid outlet
34. rear side (of the control unit)

What is claimed is:

1. An electric compressor for compressing a gas and configured for use in a motor vehicle, the electric compressor comprising:

a control unit;

an electric motor electrically connected to and controlled by the control unit, the electric motor including a stator extending about a center axis and having a continuous outer circumference;

the outer circumference of the stator defining a plurality of recesses extending radially inwardly and axially;

a compressor wheel coupled with the electric motor for being driven by the electric motor; and a housing surrounding the outer circumference of the stator of the electric motor and defining a plurality of cooling ducts for cooling the electric motor and the control unit, wherein the housing defines radially interior surfaces and radially outer surfaces of the cooling ducts, and wherein the housing extends radially into the plurality of recesses such that the cooling ducts are each received in one of the recesses of the stator;

wherein a plurality of capacitors are each located circumferentially between two adjacent recesses of the plurality of recesses of the stator.

2. The electric compressor according to claim 1, wherein the compressor wheel and the electric motor are arranged coaxially on a shaft.

3. The electric compressor according to claim 1, wherein the housing at least partially encloses the control unit.

4. The electric compressor according to claim 1, wherein a number of the cooling ducts corresponds to a number of the plurality of recesses of the stator.

5. The electric compressor according to claim 4, wherein the cooling ducts extend axially along the recesses of the stator.

6. The electric compressor according to claim 1, wherein the cooling ducts are formed at least partially along a rear side of the control unit.

7. A method for producing an electric compressor according to claim 1, wherein the housing is produced in such a way by means of an encapsulation method that the cooling ducts are formed integrally with the housing, in particular in the housing.

8. The method according to claim 7, wherein the cooling ducts are formed by means of internal-pressure injection moulding or by the introduction of at least one moulding body.

9. The method according to claim 8, wherein the moulding body is removed mechanically, by a chemical reaction, or by a thermal reaction after the encapsulation process.

10. An electric compressor for compressing a gas and configured for use in a motor vehicle, the electric compressor comprising:

a control unit;

an electric motor electrically connected to and controlled by the control unit, the electric motor including a stator extending about a center axis and having an outer circumference;

the outer circumference of the stator defining a plurality of recesses extending radially inwardly and axially;

a compressor wheel positioned about the center axis and coupled with the electric motor for being driven by the electric motor; and a housing radially surrounding the stator and defining a plurality of axially extending cooling ducts, the housing extending into the recesses of the stator such that the cooling ducts are each received by one of the recesses of the stator for cooling the electric motor and the control unit, and wherein an entire outer perimeter of each of the cooling ducts is defined by the housing;

wherein a plurality of capacitors are each located circumferentially between two adjacent recesses of the plurality of recesses of the stator.

11. The electric compressor according to claim 10, wherein the outer perimeter of each of the cooling ducts includes a radially interior surface defined by the housing, a radially outer surface defined by the housing, and a pair of side edges extending between the radially interior and outer surfaces and defined by the housing.

12. The electric compressor as set forth in claim 11 wherein the stator includes a plurality of windings being circumferentially spaced from one another, and wherein the recesses each extend across at least a majority of a circumferential distance between two adjacent windings of the plurality windings.

13. The electric compressor as set forth in claim 10 wherein the cooling ducts are each located circumferentially between two adjacent capacitors of the plurality of capacitors and wherein each of the cooling ducts are at least partially radially aligned with the capacitors.

14. An electric compressor for compressing a gas and configured for use in a motor vehicle, the electric compressor comprising:

a control unit;

an electric motor electrically connected to and controlled by the control unit, the electric motor including a stator extending about a center axis and having an outer circumference;

the outer circumference of the stator defining a plurality of recesses extending radially inwardly and axially;

a compressor wheel positioned about the center axis and coupled with the electric motor for being driven by the electric motor; and a housing radially surrounding the stator and defining a plurality of axially extending cooling ducts, the housing extending into the recesses of the stator such that the cooling ducts are each received by one of the recesses of the stator for cooling the electric motor and the control unit, and wherein an entire outer perimeter of each of the cooling ducts is defined by the housing;

wherein the stator includes a plurality of windings being circumferentially spaced from one another, and wherein the recesses each extend across at least a majority of a circumferential distance between two adjacent windings of the plurality windings;

wherein the stator includes a stator carrier radially surrounding the plurality of windings and defining the outer circumference of the stator and the recesses, and wherein the stator carrier defines a plurality of projections extending radially outwardly, each circumferentially between two adjacent recesses of the plurality of recesses.

15. The electric compressor as set forth in claim 14 wherein a plurality of capacitors are each located circumferentially in alignment with and radially outwardly of one of the plurality of projections, wherein the cooling ducts are each located circumferentially between two adjacent capacitors of the plurality of capacitors, and wherein each of the cooling ducts are at least partially radially aligned with the capacitors.

* * * * *